US006766795B1

(12) United States Patent
Sullivan

(10) Patent No.: US 6,766,795 B1
(45) Date of Patent: Jul. 27, 2004

(54) PAINTBALL GUN HAVING A HINGED RECEIVER AND METHOD FOR MAKING SAME

(75) Inventor: Brian Sullivan, Alta Loma, CA (US)

(73) Assignee: Pursuit Marketing, Inc., Schiller Park, IL (US)

( * ) Notice: Subject to any disclaimer, the term of this patent is extended or adjusted under 35 U.S.C. 154(b) by 0 days.

(21) Appl. No.: 10/058,607

(22) Filed: Jan. 28, 2002

(51) Int. Cl.[7] ..... F41B 11/00
(52) U.S. Cl. ..... 124/56; 42/75.03
(58) Field of Search ..... 124/76, 73, 71, 124/72, 74, 75, 77, 56; 42/75.01, 75.02, 75.03

(56) References Cited

U.S. PATENT DOCUMENTS

| | | | | | |
|---|---|---|---|---|---|
| 1,316,510 | A | * | 9/1919 | Rosebush | 42/75.02 |
| 3,022,779 | A | * | 2/1962 | Benkoe | 124/57 |
| 3,233,601 | A | * | 2/1966 | Walther | 124/69 |
| 3,318,192 | A | * | 5/1967 | Miller et al. | 89/142 |
| 4,541,192 | A | | 9/1985 | Flodman et al. | |
| 4,999,939 | A | * | 3/1991 | Reese et al. | 42/40 |
| 5,165,383 | A | | 11/1992 | Ebert et al. | |
| 5,303,494 | A | | 4/1994 | Tuma et al. | |
| 5,515,838 | A | | 5/1996 | Anderson | |
| 5,617,837 | A | * | 4/1997 | Momirov | 124/73 |

FOREIGN PATENT DOCUMENTS

EP 0 902 248 A2 3/1999

OTHER PUBLICATIONS

Archive.org index for www.diablodirect.com/xts.html, 2001.*
Archive.org index for www.warpig.com/paintball/articles/pressreleases/jtx.shtml, 2001.*
Sheridan Paintball Owner's Manual "Sheridan XTS .68 Caliber CO2 Paintball Marker".
Alliedsignal Inc."AlliedSignal Plastics, Advanced Elastomer Systems, Bond Flexibility to Strength—Easily" 1998, U.S.A.
Advanced Polymer Alloys Press Release Advanced Buyers' Guide To Plastics Material, Equipment, and Services, Apr. 1999, U.S.A.
Cadalyst Magazine www.cadalyst.com feature stories "Move Your Art to Part" 2001, U.S.A.
Warpig—World and Regional Paintball Information Guide Press Release "Sheridan's New JTX Marker Top Of It's Class".
Principles of Firemarns– Definitions—General "Small Arms: Firearms, Cannon, and Guns in General" 2001, Website: www.rkba.org.
Americans For Gun Safety (AGS) Foundation "Gun Safety Program" 2001, website:www.w3.agsfoundation.com.
"General Information—What is a firearm?", 20001, website:www.bnrpsc.fsnet.co.uk.

* cited by examiner

*Primary Examiner*—Charles T. Jordan
*Assistant Examiner*—John W. Zerr
(74) *Attorney, Agent, or Firm*—Neal, Gerber & Eisenberg, LLP

(57) ABSTRACT

The invention provides an improved gun for firing a projectile comprising a grip, a receiver, a projection on either the grip or receiver and a retainer fixedly attached to the other, so that the projection and retainer selectively engage each other, retaining the grip and receiver in a fixed relationship. The apparatus provides a safety retainer and a safety projection, whereby the safety retainer and safety projection engage one another when the hammer is in the ready position, maintaining the grip and receiver in the fixed relationship. A safety member is provided preventing the retainer from disengaging the projection when the hammer is in the ready position, and blocking the hammer from moving into the ready position when the retainer is not in the first position and the hammer is not in the ready position. The invention provides a process for making a receiver for firing a projectile.

9 Claims, 12 Drawing Sheets

- PRIOR ART -

PAINTBALL GUN HAVING A HINGED RECEIVER AND METHOD FOR MAKING SAME

FIELD OF THE INVENTION

The present invention relates to guns, including guns for use in the sport of paintball.

BACKGROUND OF THE INVENTION

Conventional firearms have a firing mechanism to fire a projectile and a barrel to direct the projectile in a desired direction. Guns are made for numerous purposes and include many designs, for example, rifles, shot guns, and hand guns. A broad array of different mechanisms for firing a projectile have been employed for various types of guns. For example, one type of gun is dependant on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen and carbon dioxide.

FIG. 13 illustrates the general components of a prior-art open-bolt, blow-back paintball gun. Gun 1' comprises a grip 4' and a receiver 6'. Grip 4' is attached to receiver 6' by bolts 2',2'. Grip 4' comprises a frame 8' housing a trigger 9' and sear 12' for actuating the firing sequence of gun 1' to fire the projectile, such as a paintball 15' (shown in shadow). As described in greater detail below, a firing mechanism is powered by a volume of compressed gas supplied from a compressed gas source (not shown).

As shown in FIG. 13, receiver 6' comprises a first bore 22' and a second bore 23'. The second bore 23' is adapted to receive valve body 52', which partitions second bore 23' into a first chamber 24' and second chamber 26'. Valve body 52' has coaxial bores 53' and 54', which are transverse to bore 59', which act as fluid ports 53' and 54' and 59'. The diameters of bores 53', 54' and 59' are selected to achieve a ratio of fluid flow between port 54' and 59' to accommodate the proper firing and reload functions of the gun, as described below. Valve body 52' is sealed by 0-rings 48' and 50', and secured in receiver 6' by bolt 56'. Poppet 51' is seated in ports 53' and 54' and maintained by spring (not shown). Poppet 51' is comprised of valve pin 60' and valve cup seal 62'. Valve cup seal 62' is threaded on valve pin 60'.

Receiver 6' further houses a firing assembly 25' comprising a rear housing 27', a hammer 29', and a firing bolt 31'. In particular, firing bolt 31' is housed in first bore 22' and hammer 29'is housed in second chamber 26'. Firing bolt 31' is further attached to a cocking shaft, which passes through the rear housing 27' and terminates in a cocking knob 33'. Rear housing 27'partially houses and retains spring retainer 37', which supports spacer 38' and spring 39'. Spring 39' fits in hammer 29', which is connected to firing bolt 31' by pin 42'. Bolt 34' may be rotated to increase or decrease tension on spring 39', which in turn adjusts the speed with which hammer 29' is released and, as a result, controls the amount of compressed air that is released, which ultimately controls the velocity of the paintball when fired. Firing assembly 25' is secured in receiver 6' by pin 36'.

Pulling back on the cocking knob 33' pulls firing bolt 31' toward the ready (cocked) position. Because firing bolt 31' is connected by pin 42' to hammer 29', hammer 29' is also drawn back until hammer 29' deflects sear 12', and sear 12' engages hammer catch 47' on hammer 29'. When hammer catch 47' is so engaged by sear 12', hammer 29' is in the ready position. When trigger 9' is pulled, trigger 9' rotates sear 12' around pin 49', disengaging hammer 29' from sear 12' and releasing hammer 29' into the firing position, thus initiating the firing sequence, described as follows.

When hammer 29' hits valve pin 60' of poppet 51', poppet 51' is unseated from port 53', and pressurized air contained in first chamber 24' is released through port 53' and discharges through valves 54' and 59'. At this point in the firing sequence, when hammer 29' is near the valve pin 60' (the firing position), bolt port 57' is aligned with port 59'. Thus, when compressed air is released from first chamber 24', some of this air flows through port 59', which then flows through bolt port 57' to fire projectile 15'.

Meanwhile, the remaining portion of air, which flows through port 53' but does not flow through bolt port 59', instead flows through port 54'. This air creates pressure in blow-back chamber 63', which is formed by second chamber 26' and hammer 29', creating air pressure against hammer 29' to recoil (or "blow back") hammer 29' toward the ready position, until sear 12' engages hammer catch 47'. Vent 64' releases the air pressure in the blow-back chamber 63' as the hammer 29' is propelled into the ready position, so that hammer 29' may fire again in the next round. After hammer 29'displaces poppet 51', tension from spring (not shown) along with compressed air pressure against poppet 51' reseats poppet 51', closing port 53'. Gun 1' is now recocked and ready for firing. This firing sequence is known as semi-automatic, because the gun automatically recocks itself after firing.

As will be understood by one of skill in the art, the balance of compressed gas flowing between ports 54' and 59' will affect the velocity of the projectile 15' and the velocity that hammer 29' is "blown back". One way of apportioning the amount of air that flows through either port 54' or port 59' of valve body 52' is established by the respective diameters of ports 54'and 59'. Another way of establishing the respective air flow between port 54' and 59' is by adapting a non-circular cross-section for valve pin 60'. For example, valve pin 60' may be provided with a longitudinal cut away or groove, which allows additional airflow through port 54'. These variables may be adjusted by those skilled in the art to achieve an optimum balance for gas efficiency and firing velocity.

A drawback to conventional blow-back paintball guns 1' makes it difficult to replace the hammer 29' after disassembly after cleaning. When hammer 29' is removed from receiver 6', the sear 12' extends into receiver 6' and blocks the path of hammer 29', preventing hammer 29' from returning into receiver 6'. In conventional blow-back paintball guns 1', sear 12' must be manipulated into a disengaging position, which can be achieved by removing grip 4', actuating trigger 9' and sear 12' assembly, or manually disengaging sear 12' before returning hammer 29' into receiver 6'.

The introduction of debris into the firing mechanism of any firearm can affect the ability of the firearm to fire a projectile and affect the accuracy of the shot. For example, debris can jam the firing mechanism or debris can deflect or obstruct the path of a projectile within the barrel. In the case of paintball guns, the projectile is a paintball, which is a volume of paint encased in a spherical shell comprised of a breakable casing. The paintball is designed to explode upon impact against an intended target, but occasionally paintballs inadvertently break prematurely before impact, and can even burst while loading or firing within the paintball gun. Paint residue from an exploded paintball remaining inside the paintball gun typically inhibits the trajectory and speed of later-fired paintballs and can even jam the paintball gun.

As a result, it is desirable to provide an improved paintball gun that is easily disassembled and reassembled for cleaning. It is also desirable to provide a high-performance paintball gun that can be manufactured more cost-effectively by the use primarily of polymer material rather than metal. The present invention solves the foregoing and other problems in the art and satisfies the industry demands.

SUMMARY OF INVENTION

It is an object of the invention to provide an apparatus for firing a paintball projectile, wherein the apparatus comprises a grip and a receiver hingingly attached to the grip, which enables the grip and the receiver to move from an adjacent position to an open position. The invention further provides a projection on one of either the grip or the receiver, which if cooperatively engages a retainer fixedly attached to the other of either the grip or the receiver. The projection and the retainer thus cooperate to selectively engage each other, thereby retaining the grip and the receiver in a fixed relationship. It is a further object of the invention for the projection to be adapted to receive the retainer and to provide the retainer to be capable of moving from a first position to a second position, wherein the retainer engages with the projection in the first position and the retainer disengages the projection in the second position.

In a further aspect of the invention, the apparatus further comprises a safety retainer. In this aspect of the invention, the apparatus has a hammer housed within the receiver and the hammer is capable of moving from a ready position to a firing position when the grip and the receiver are in the adjacent position. A safety retainer is associated with the receiver, and a safety projection is associated with the grip. The safety retainer and safety projection engage one another when the hammer is in the ready position, and thereby maintain the grip and the receiver in the fixed relationship, regardless of whether the projection and the retainer are engaged. This prevents an inadvertent release of the grip and the receiver during operation.

In yet another aspect of the present invention, a safety member is provided that prevents the retainer from disengaging the projection when the hammer is in the ready position. This prevents the apparatus from being opened when the hammer is cocked. According to another feature of the safety member, when the hammer is not in the ready position and when the retainer is not in the first position, the retainer urges the safety member into a position whereby the safety member blocks the hammer from moving into the ready position. This prevents the hammer from being cocked if the apparatus is not securely closed.

In yet another aspect of the present invention, when the grip and the receiver are in the open position, the hammer may be inserted into the receiver without contacting the sear.

In another aspect of the present invention, the apparatus for firing a paintball projectile comprises a grip, a firing assembly, which comprises a rear housing, a hammer, and a firing bolt, and a receiver for housing the firing assembly. A projection is provided on one of either of the firing assembly or the grip, and a receptacle is provided on the other of either the firing assembly or the grip. The receptacle cooperates to selectively engage the projection, thereby retaining the firing assembly in the receiver.

In yet a further aspect of the invention, a receiver is provided for firing a projectile. The receiver comprises a body, which defines a first bore and a second chamber. The second chamber is adapted to receive a hammer, which has a leading end. The hammer travels along a defined path within the second chamber. The body defines a vent between the first bore and the second chamber along at least a portion of the path of the leading end of the hammer.

In a further aspect of the invention, a receiver for firing a projectile is provided. The receiver comprises a body, which defines a first bore adapted to receive a firing bolt and a first chamber adapted to contain compressed fluid. The body further defines a first port integrally formed by the body for communicating compressed fluid from the first chamber to the first bore. The body further defines a second chamber adapted to receive a hammer, and the body further defines a second port integrally formed by the body for communicating compressed air from the first chamber to the second chamber. In another aspect of the invention, a valve body is integrally formed from the receiver, which defines a first port for communicating fluid between the first chamber and the first bore. The valve body further defines a second port for communicating fluid from the first chamber to the second chamber.

The invention further provides a process for making a receiver for firing a paintball comprising the following steps. Insert a core into a mold. The core comprises a first cylinder, a second cylinder, and a web attaching the first cylinder in parallel to the second cylinder, thereby forming two linearly-adjacent cylinders. The next step is to inject a plastic material into the mold. Next, remove the core from the mold. Finally, remove the receiver from the mold.

The invention further provides a process for making a receiver for firing a paintball comprising the following steps. Insert a core into a mold. The core comprises a first cylinder having a first diameter, a second diameter, and a third diameter, wherein the second diameter is smaller than the first and third diameters. The core further comprises a second cylinder positioned in parallel with the first cylinder. Next inject a plastic material into the mold. Next, remove the core from the mold and the receiver from the mold. Finally, create an airflow passage between the second diameter of the first cylinder and the second cylinder.

The foregoing features and advantages of the present invention will be apparent from the following more detailed description of the invention. Other features and advantages of the invention will be apparent from the following detailed description and accompanying figures.

DETAILED DESCRIPTION OF THE INVENTION

Figure 1:
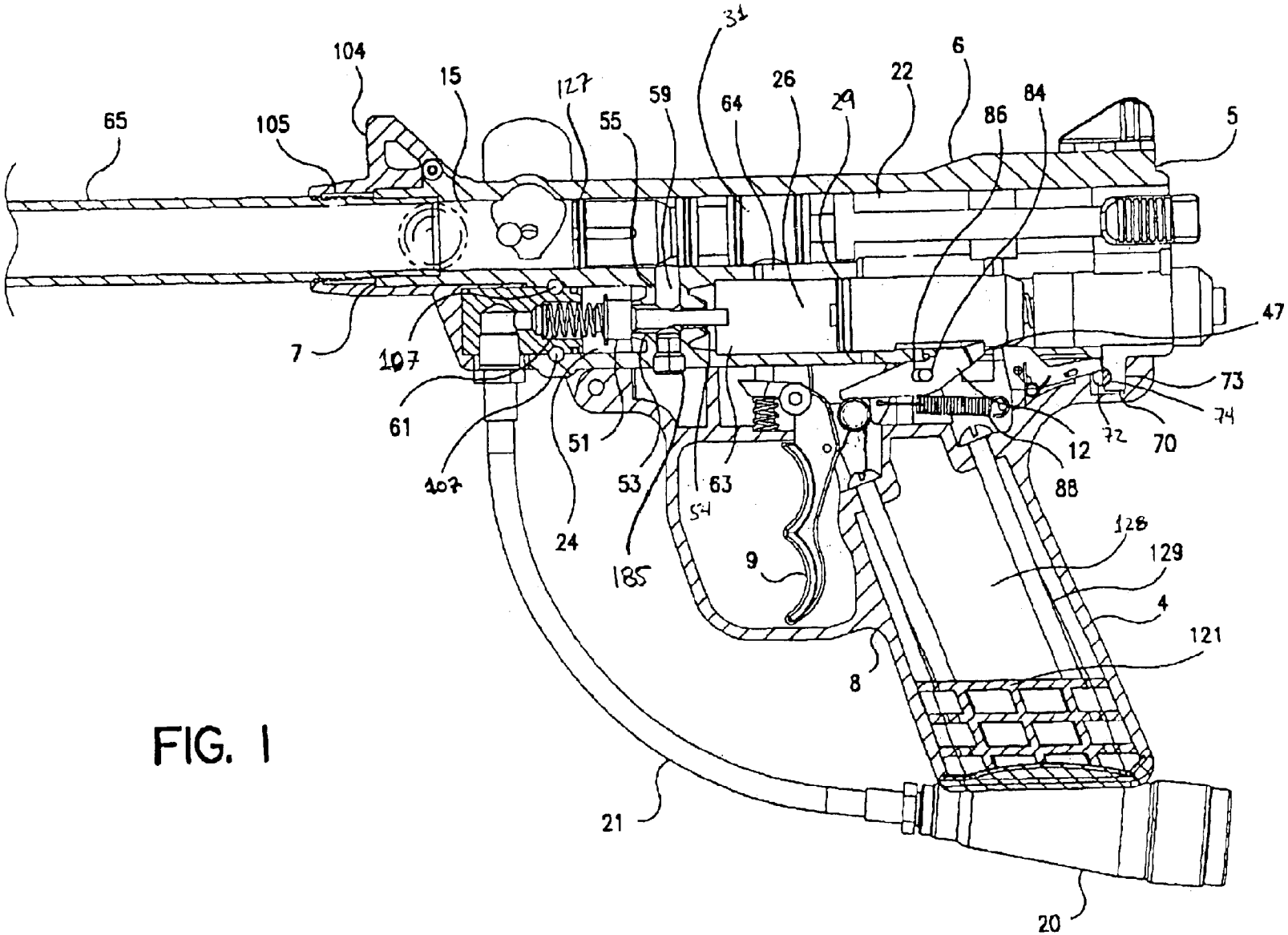
FIG. 1 is a plan view of a paintball gun of the present invention in the ready position showing the receiver and the grip cut away at the midsection to illustrate the internal components.

As illustrated in FIG. 1, gun 1 comprises a grip 4 and a receiver 6. Grip 4 comprises a frame 8 housing a trigger 9 and sear 12 for actuating the firing sequence of gun 1 to fire the projectile, such as a paintball 15 (shown in shadow).

Figure 3:
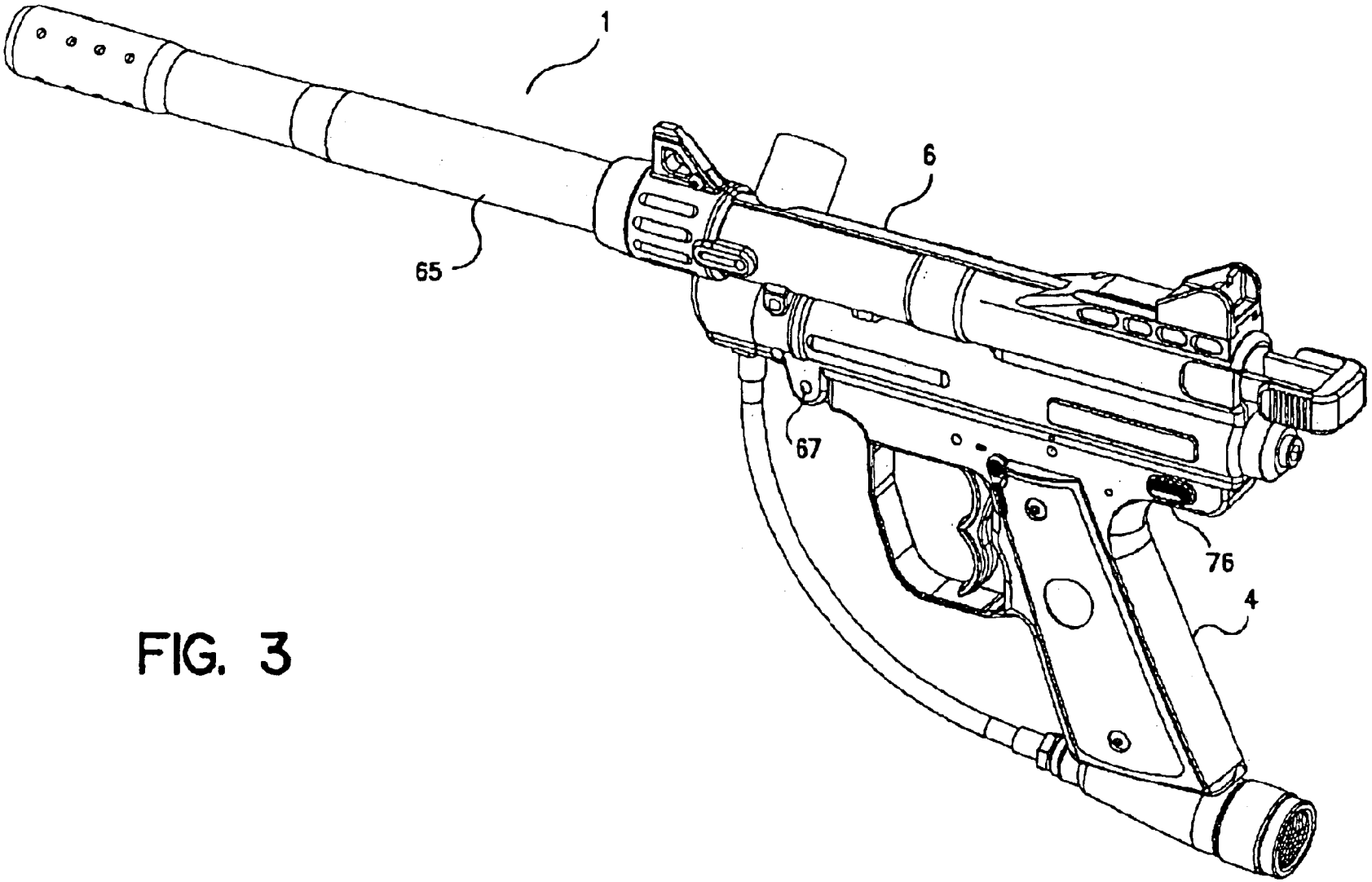
FIG. 3 is a perspective view of the embodiment shown in FIG. 1 shown in the cocking position.
Figure 5:
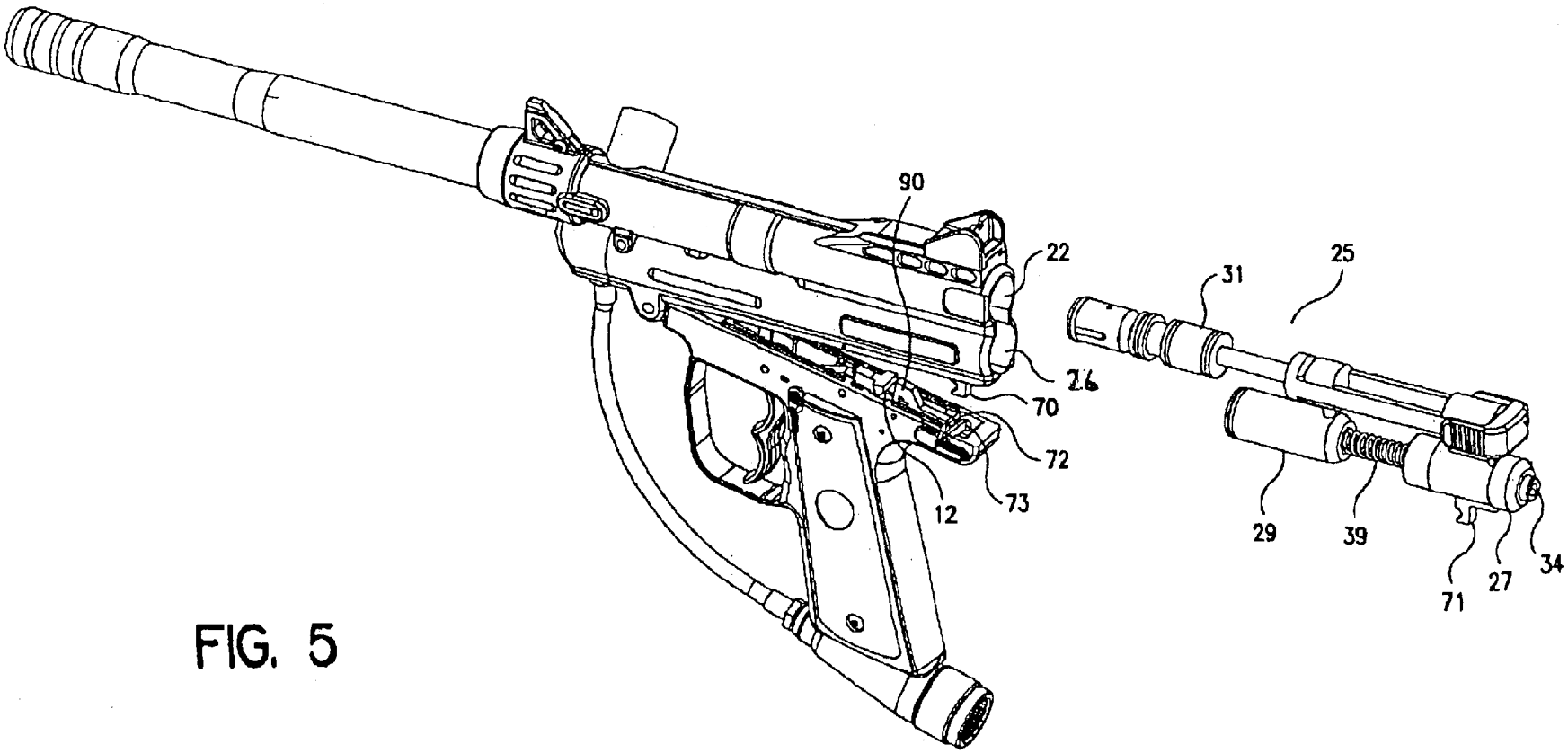
FIG. 5 is a perspective view of the embodiment shown in FIG. 1 shown the open position and illustrating the removal of the firing assembly.
Figure 6:
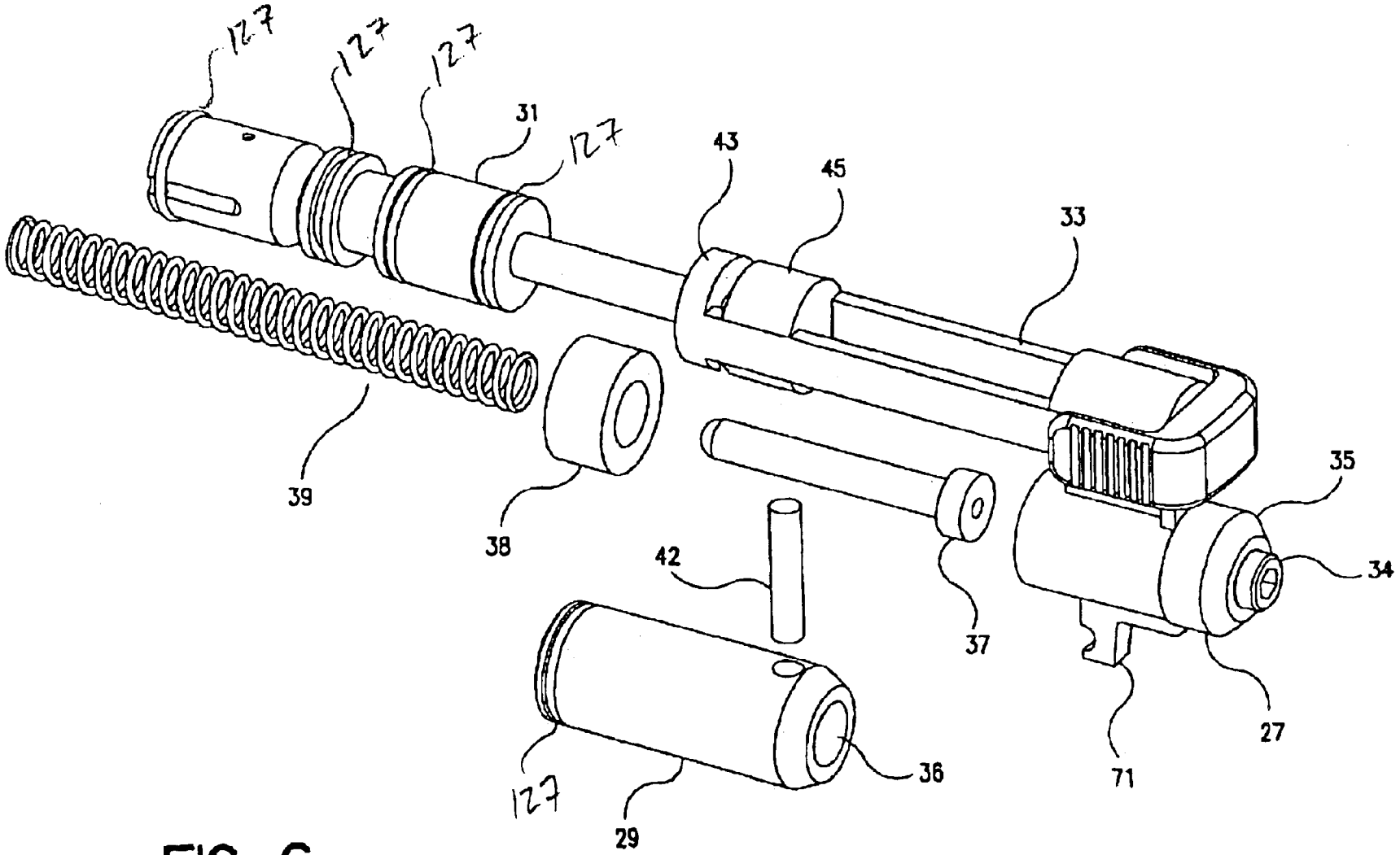
FIG. 6 is a perspective view of a partially exploded firing assembly of the embodiment shown in FIG. 1.

As shown in FIG. 1, receiver 6 contains first bore 22, first chamber 24, and second chamber 26. Turning to FIGS. 5 and 6, receiver 6 further houses a firing assembly 25, which comprises rear housing 27, hammer 29, and firing bolt 31. More specifically, firing bolt 31 is slideably housed in first bore 22 and hammer 29 is slideably housed in second chamber 26. Firing bolt 31 is adapted to slideably engage a cocking knob 33, which, in turn, is linked to rear housing 27. Rear housing 27 houses bolt 34. Rear housing 27 is recessed to support spring retainer 37, upon which is mounted spacer 38 and spring 39. Spring 39 fits into a recess 36 in hammer 29. Hammer 29 is connected to firing bolt 31 by pin 42. When the cocking knob 33 is pulled back, as illustrated in FIG. 3, the knob flange 43 on cocking knob 33 engages firing bolt 31 at bolt flange 45 and pulls firing bolt 31 toward the ready (cocked) position. As shown in FIG. 1, sear 12 engages hammer catch 47, securing hammer 29 in the ready position. Cocking knob 33 is then retractable into receiver 6.

FIG. 6 further shows gaskets 127 on firing bolt 31 and hammer 29. Gaskets 127 are quad-rings in contrast to O-rings commonly used in the paintball industry. Whereas O-rings have a circular cross-section, quad-rings have a four-pointed-star cross-section, which can be pictured roughly as a square with the sides of the square bending inwards. When gaskets 127 are in use, that is, mounted on firing bolt 31 and hammer 29, each of the four corners of the rings are adjacent a surface. For example, when firing bolt 31 is placed in receiver 6, two corners of gasket 127 are adjacent the receiver and two corners are adjacent firing bolt 31. While the corners are in close proximity to receiver 6, they do not form a seal when firing bolt 31 is static. However, upon an impulse of gas, for example during the firing sequence of paintball gun 1, the quad-ring is compressed on the pressurized side forcing the pressured-side corners outward and creating a tight seal. This contrasts with common O-rings, which are designed to create a constant seal between two adjacent surfaces even when parts are static. But under pressure, the quad-rings create a tighter seal than O-rings. This tighter seal creates more drag on the moving part, that is, firing bolt 31 and hammer 29, which slows down the part. Because firing bolt 31 is made of a polymer, which is lighter than conventional metal firing bolts, the quad-rings 127 allow proper timing of the gun, which may not otherwise be achieved with conventional O-rings.

Figure 4:
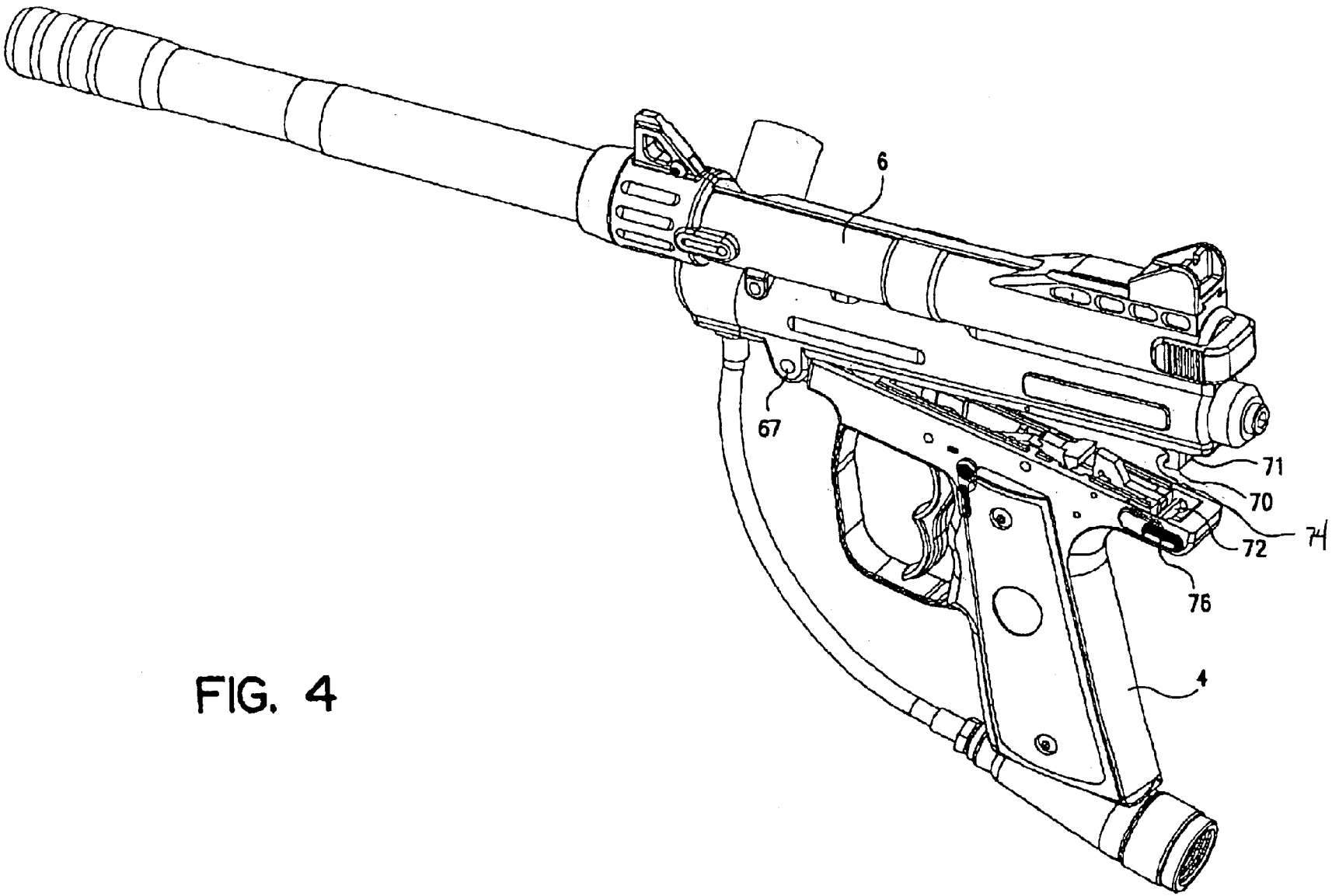
FIG. 4 is a perspective view of the embodiment shown in FIG. 1 shown in the open position.

As shown in FIGS. 3 and 4, receiver 6 is hingingly attached to grip 4, enabling grip 4 and receiver 6 to move from an adjacent position (shown in FIG. 3) to an open position (shown in FIG. 4). Pin 67 hinges grip 4 and receiver 6, although other hinging devices may be used, as known in the art, such as a plastic hinge.

To maintain the grip 4 and the receiver 6 in an adjacent position, projection 70 is provided on receiver 6 and retainer 72 is fixedly attached to grip 4. Projection 70 cooperates with retainer 72 to selectively engage retainer 72. As would be understood by one of ordinary skill in the art, projection 70 could, instead, be placed on grip 4 and retainer 72 could, instead, be placed on receiver 6 without departing from the invention. When projection 70 and retainer 72 engage each other, grip 4 and receiver 6 are thereby retained in a fixed relationship.

Figure 7:
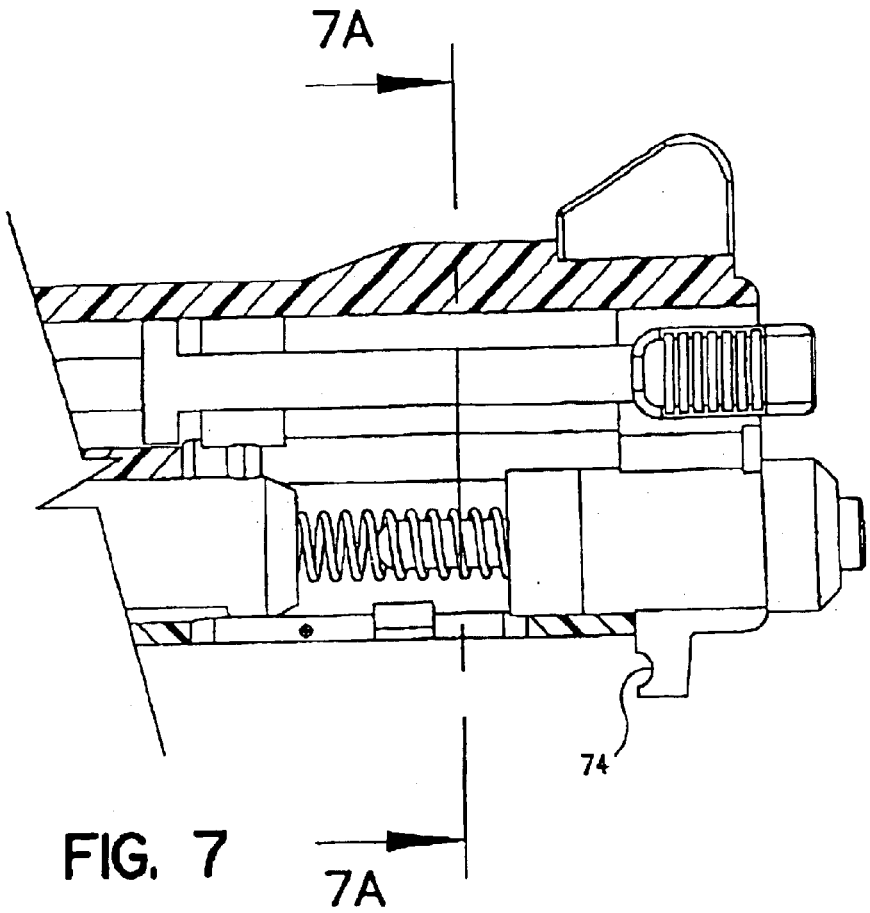
FIG. 7 is a plan view of the rear portion of the embodiment shown in FIG. 1 with a cut-away of the receiver and reflecting cross-section line 7A—7A.
Figure 7A:
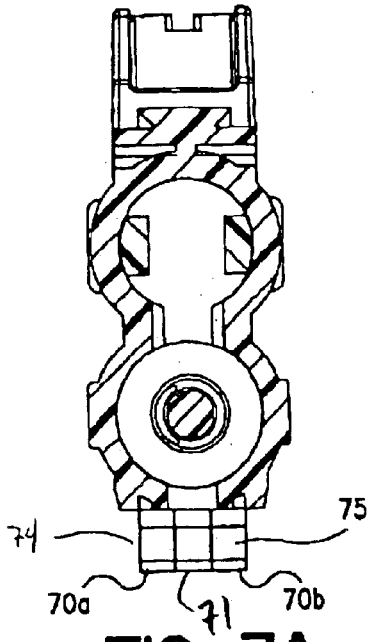
FIG. 7A is cross-sectional view 7A—7A of the rear portion of the embodiment shown in FIG. 7.
Figure 8:
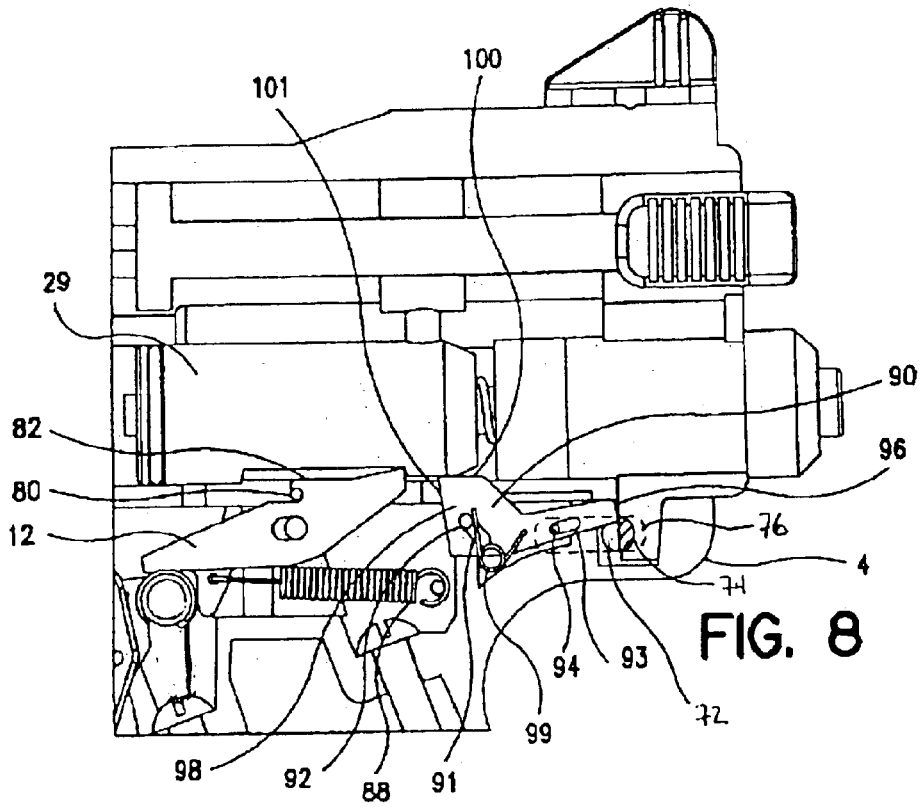
FIG. 8 is a cross-sectional view of the rear portion of the embodiment shown in FIG. 1 showing the hammer in the ready position.
Figure 9:
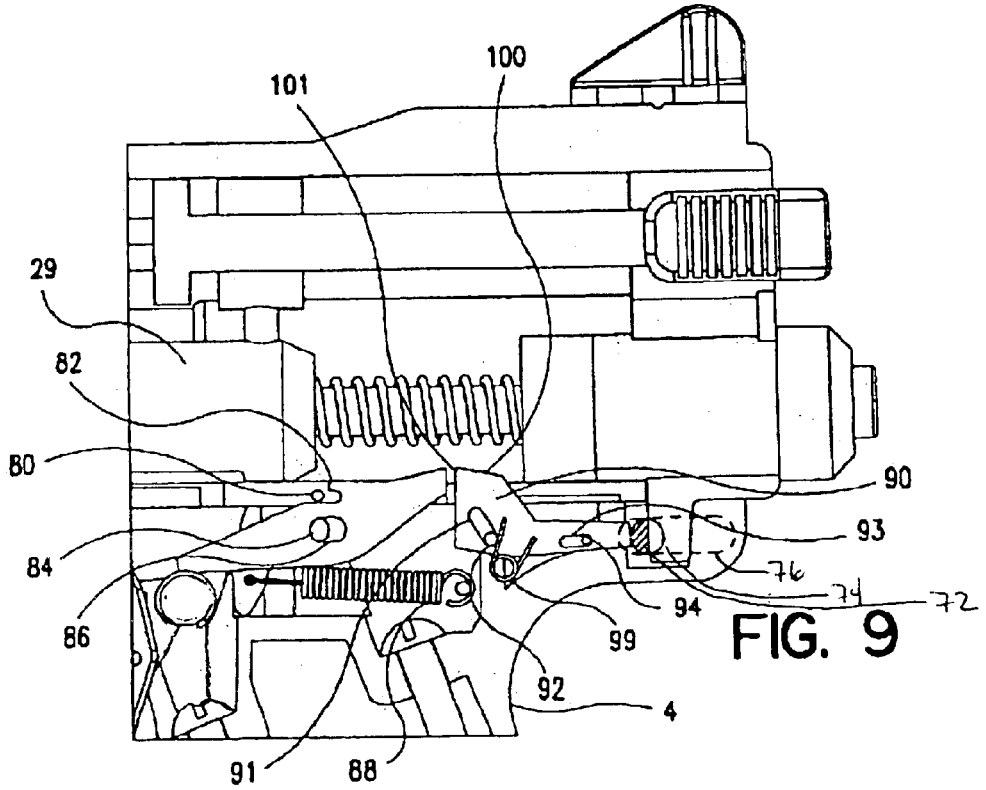
FIG. 9 is a cross sectional view of the rear portion of the embodiment shown in FIG. 1 showing the hammer in the released position.

FIGS. 8 and 9 illustrate how projection 70 and retainer 72 engage each other. Specifically, retainer 72 is capable of moving from a first position to a second position. In the first position (shown in FIG. 8), retainer 72 engages projection 70. In the second position (shown in FIG. 9), retainer 72 disengages projection 70. As shown in FIG. 7, projection 70 further has an engaging surface 74 adapted to mate with retainer 72. Engaging surface 74 comprises a substantially semicircular channel 75 and retainer 72 is a semi-circular shaft. FIG. 7A shows that engaging surface 74 may be in the form of a channel 75 positioned transversely along projection 70. FIG. 7A further illustrates an embodiment where projection 70 may be further divided into multiple projections 70*a* and 70*b*.

Retainer 72 is positioned to mate with engaging surface 74 in the first position and to disengage engaging surface 74 when rotated 180° into the second position. Retainer 72 can be moved from the first position to the second position by rotating lever 76, which is attached to retainer 72. FIG. 3 shows rotating lever 76 in the first position, and FIG. 4 shows rotating lever 76 in the second position (rotating lever 76 is also shown in shadow in FIGS. 8 and 9). Thus, in one embodiment, the retainer 72 may also be described as a rotating locking pin. In other embodiments, which will be understood by those skilled in the art, the retainer may be adapted to slide from the first position to the second position to engage the projection. In yet another embodiment, the engaging surface may be a notch. In still other embodiments the retainer may be a moveable or removable latch, or a pin.

Figure 2:
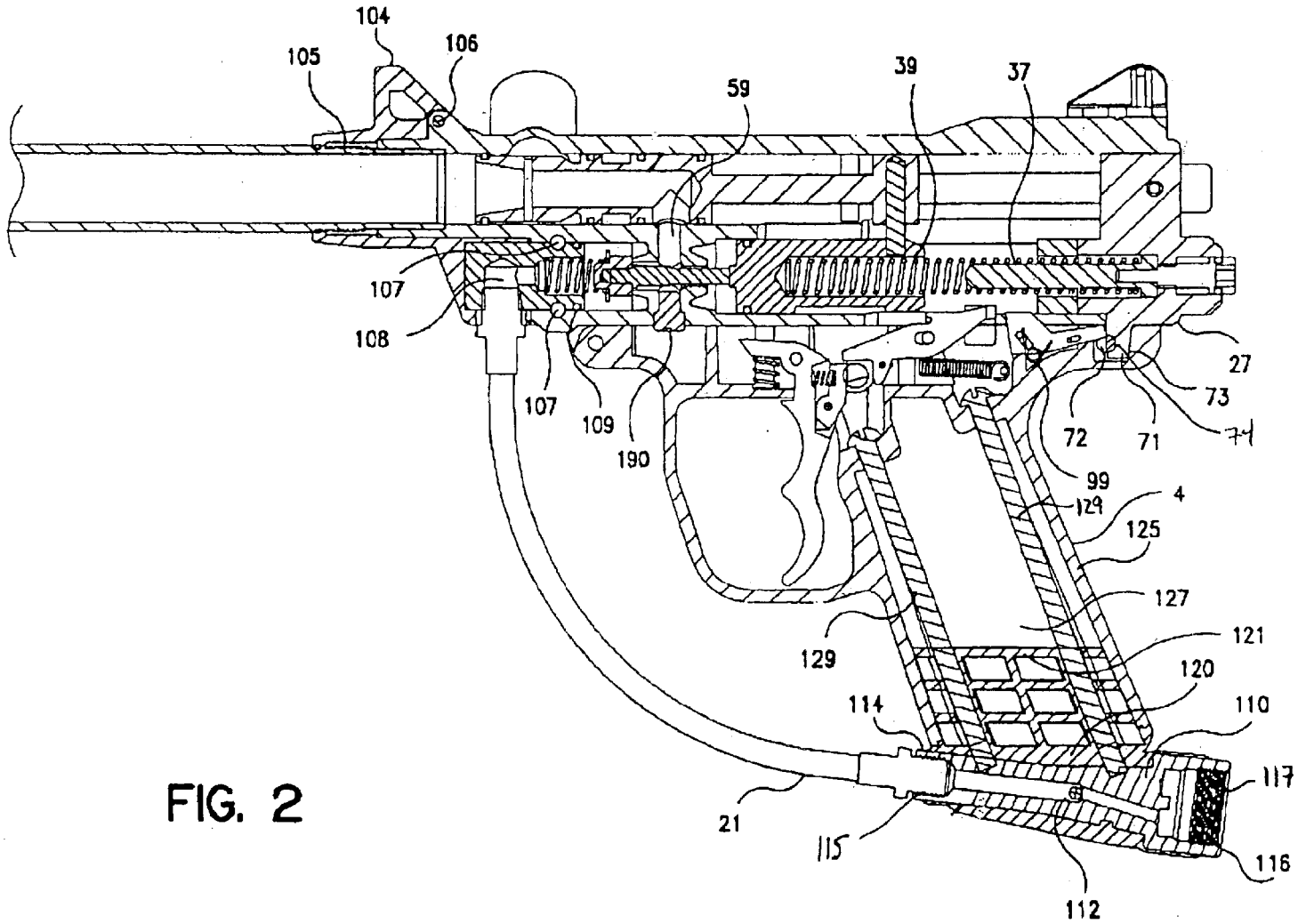
FIG. 2 is a cross-sectional plan view of the embodiment shown in FIG. 1 in the firing position.

As described above, hammer 29 is housed within receiver 6, and when grip 4 and receiver 6 are in the adjacent position, hammer 29 is capable of moving from a ready position, also referred to as a cocked position (shown in FIG. 1) to a firing position (shown in FIG. 2). Because the gun 1 operates under high air pressure generally, and the hammer 29 is subject to spring tension and air pressure in the firing position, releasing the grip 4 and receiver 6 into the open position while under pressure could cause the hammer 29 or other components to be in inadvertently expelled from the receiver 6.

To prevent the inadvertent opening of the grip 4 from the receiver 6, the following feature is described. FIGS. 8 and 9 illustrate safety retainer 80 associated with receiver 6 and safety projection 82 associated with grip 4. Safety retainer 80 and safety projection 82 engage one another when hammer 29 is in the ready position, as shown in FIG. 8. When safety retainer 80 is engaged with safety projection 82, grip 4 and receiver 6 are maintained in the fixed relationship, regardless of whether projection 70 and retainer 72 are engaged. In particular, sear 12 is mounted on grip 4 and safety projection 82 is attached to sear 12, thereby associating safety projection 82 with grip 4. Sear 12 is mounted to grip 4 by pin 84 through slot 86, and spring 88 retains tension on sear 12, which pulls sear 12 toward the rear of gun 1. When hammer 29 is in the firing or released position, as shown in FIG. 9, spring 88 pulls sear 12, which is mounted on pin 84 within slot 86, into a third position (as distinguished from the first and second position of retainer 72, described above), whereby the safety projection 82 disengages safety retainer 80. When hammer 29 is cocked, that is, in the ready position, as shown in FIG. 8, sear 12 engages hammer 29 and spring 39 urges hammer 29, which in turn urges sear 12 from the third position, to the fourth position, in which safety projection 82 engages safety retainer 80 (as shown in FIG. 8). Sear 12 is thus moveable from a third position, in which the safety projection 82 is disengaged from safety retainer 80, to a fourth position, in which safety projection 82 engages safety retainer 80.

In a further safety feature, also shown in FIGS. 8 and 9, safety member 90 is provided. Safety member 90 is mounted in grip 4 by pins 92, 94, which pass through slots 91, 93, respectively. Slots 91, 93 allow safety member 90 to slide on pins 92, 94 between a fifth position and a sixth position (as distinguished from the first and second position of retainer 72 and the third and fourth position of safety projection 82, described above). Safety member 90 has first end 96 and second end 98. Spring 99 maintains first end 96 in contact with retainer 72. Second end 98 has hammer-engaging surface 100 and hammer-blocking surface 101.

The safety member 90 operates as follows. When retainer 72 is in the first position, spring 99 maintains safety member 90 in the fifth position, wherein second end 98 is retracted in grip 4 and hammer-engaging surface 100 is substantially flush with the contour of second chamber 26, which houses hammer 29. As shown in FIG. 8, when safety member 90 is in the fifth position and hammer 29 is cocked (in the ready position) hammer-engaging surface is substantially flush with hammer 29. In contrast, when retainer 72 is moved from the first position, retainer 72 urges safety member 90 into the sixth position. When safety member 90 is in the sixth position, second end 98 is extended into the second chamber 26, and hammer-blocking surface 101 blocks the path of hammer 29, preventing hammer 29 from engaging sear 12.

As can be understood from FIGS. 8 and 9, the operation of safety member 90 has several functions. First, as shown in FIG. 8, when hammer 29 is in the ready position, hammer-engaging surface 100 of safety member 90 is adjacent hammer 29, which prevents retainer 72 from moving into the second position and disengaging projection 70. As a result, retainer 72 cannot be disengaged (and gun 1 cannot be opened) while hammer 29 is in the cocked or ready position. Second, as long as retainer 72 is not fully in the first position, hammer-blocking surface 101 of safety number 90 blocks the path of hammer 29, thereby preventing hammer 29 from being cocked. Thus a user will be unable to inadvertently cock the hammer when the retainer 72 is not fully closed.

Separately, hingingly attaching grip 4 and receiver 6 provides another feature for reassembling the gun 1. Specifically, when grip 4 and receiver 6 are in the open position as shown in FIG. 5, hammer 29 may be inserted into receiver 6 without contacting sear 12. This feature avoids having to manipulate sear 12, as required in conventional blow-back paintball guns to insert hammer 29 in receiver 6.

The present invention further maintains firing assembly 25 in the receiver 6. As illustrated in FIGS. 1 and 5, receiver 6 houses firing assembly 25, which as discussed above, a comprises rear housing 27, hammer 29, and firing bolt 31. Projection 71 on firing assembly 25 selectively engages receptacle 73 formed by grip 4, which selectively maintains firing assembly 25 in the receiver 6.

As can be further seen, projection 71 is selectively moveable between a first position (shown in FIG. 2) and a second position (shown in FIG. 4). In the first position, receptacle 73 engages projection 71 and in the second position, receptacle 73 disengages projection 71. Thus projection 71 and receptacle 73 cooperatively retain firing assembly 25 in receiver 4 when projection 71 is in the first position. Conversely, projection 71 and receptacle 73 cooperatively release firing assembly 25 from receiver 4 when projection 71 is in the second position.

As discussed above, grip 4 can be hingingly attached to receiver 6, allowing grip 4 and receiver 6 to be selectively positioned into a closed position, wherein grip 4 is adjacent receiver 6, shown in FIG. 1, and an open position, wherein grip 4 is partially spaced away from receiver 6, shown in FIG. 4. When in the closed position, projection 71 is retained by receptacle 73 and when in the open position, projection 71 is released from receptacle 73. To further prevent receptacle 73 from releasing projection 71, retainer 72 selectively engages projection 71 when grip 4 and receiver 6 are in the closed position. Thus when retainer 72 is in the first position, projection 71 is locked within receptacle 73.

It will be apparent to those of skill in the art that the respective positions of projection 71 and receptacle 73 may be reversed, without departing from the present position, that is, projection 71 may be attached to grip 4 and receptacle 73 may be associated with firing assembly 25. In addition, projection 71 may be adapted to slide from the first position to the second position, and many other means of cooperatively retaining projection 71 by receptacle 73 will be understood by those of skilled in the art, including retractable pins or latches, and cotter pins, to name just a few.

FIG. 1 illustrates receiver 6 of gun 1 of the present invention. Receiver 6 (also referred to as body 6) defines first bore 22 and second chamber 26. Second chamber 26 is adapted to receive hammer 29. Hammer 29 travels along a defined path within second chamber 26, and body 6 defines vent 64 between the first bore 22 and the second chamber 26 along at least a portion of the path of leading end of hammer 29. Further, body 6 has first end 5 and second end 7, and vent 64 begins at first end 5 and extends along a partial length of body 6 toward second end 7 and extends over at least a portion of the path of the leading end of hammer 29.

Vent 64 may also be defined by reference to blow-back chamber 63. As described above, hammer 29 is slideably positioned within second chamber 26 of receiver 6 between a ready position, shown in FIG. 1, and a firing position, shown in FIG. 2. Blow-back chamber 63 is formed within second chamber 26 for facilitating the return of hammer 29 from the firing position to the ready position. Blow-back chamber 63 defines vent 64 between second chamber 26 and first bore 22 for allowing airflow passage.

Receiver 6 further provides integral valve 55. Receiver 6 (or body 6) defines a first port that comprises ports 53, 59 integrally formed by body 6 for communicating compressed fluid from first chamber 24 to first bore 22. Body 6 further defines a second port comprising ports 53, 54 integrally formed by the body for communicating compressed air from first chamber 24 to second chamber 26. As shown in FIG. 1, first chamber 24 is coaxial with second chamber 26, port 53 is common to both the first port and the second port so that the first port is in communication with the second port.

Figure 10:
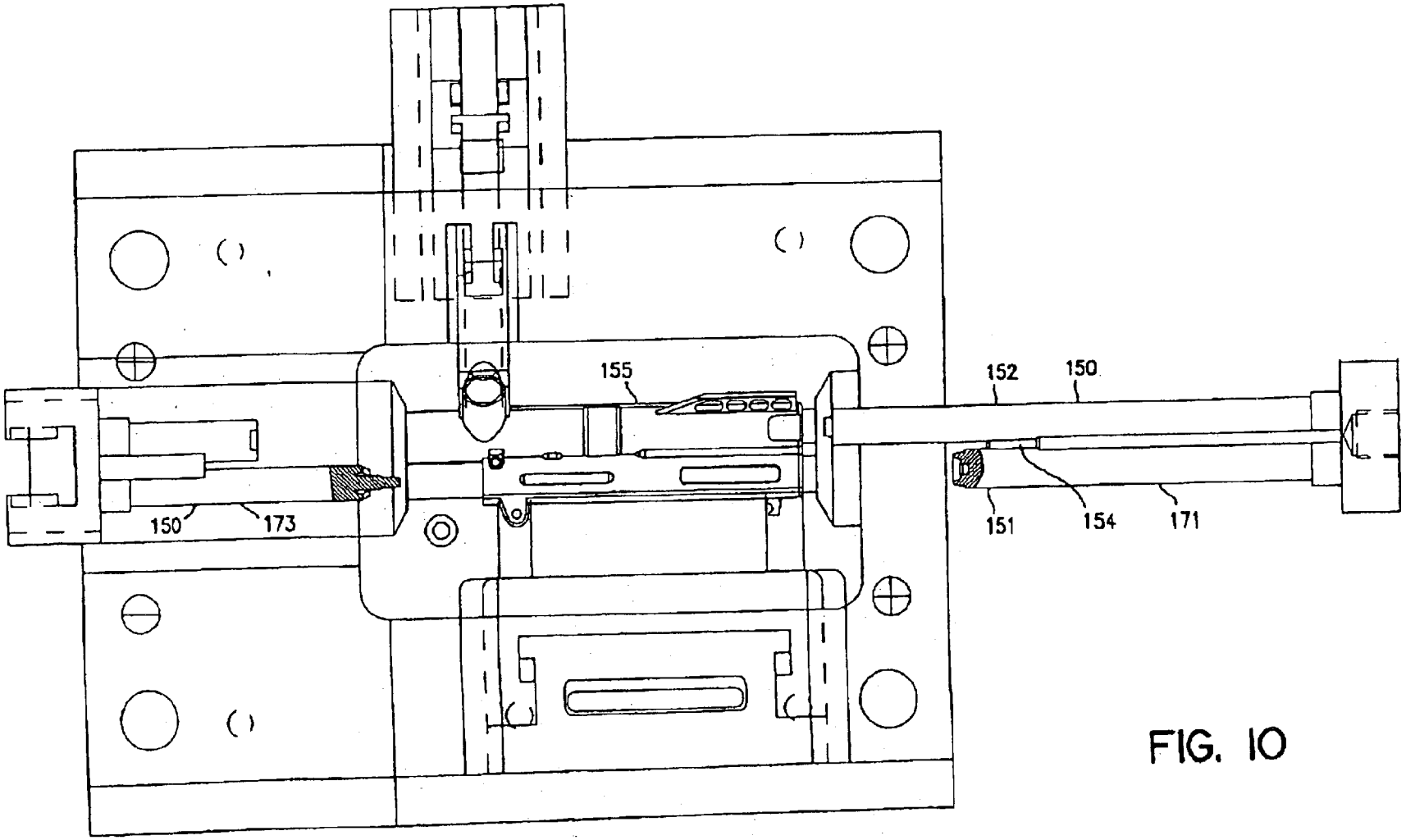
FIG. 10 is a plan view of the tooling for the receiver of the embodiment shown in FIG. 1 showing one side of the symmetrical mold and the cores apart.
Figure 11:
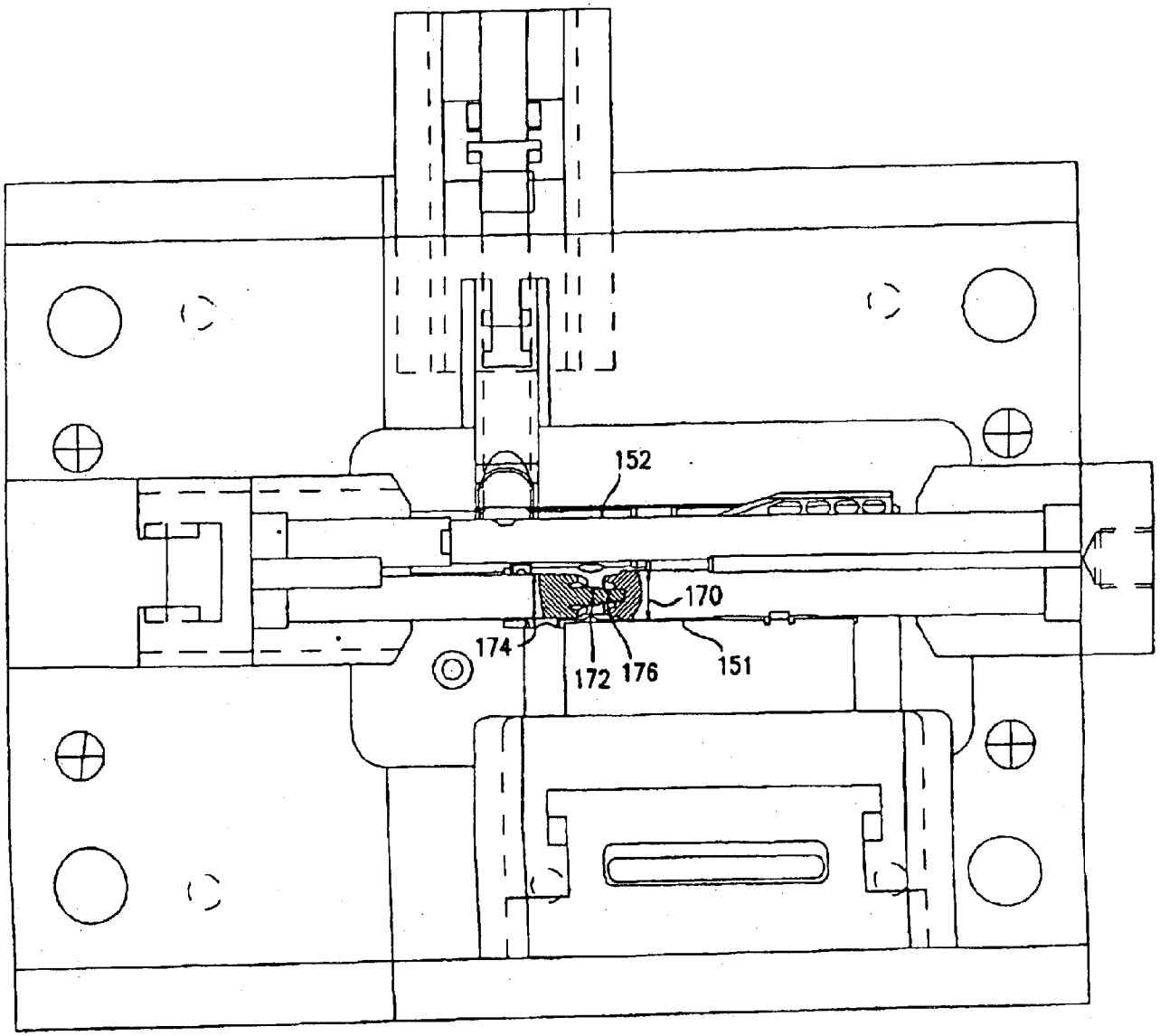
FIG. 11 is a plan view of the tooling shown in FIG. 10 showing the cores in a matrix position.
Figure 12:
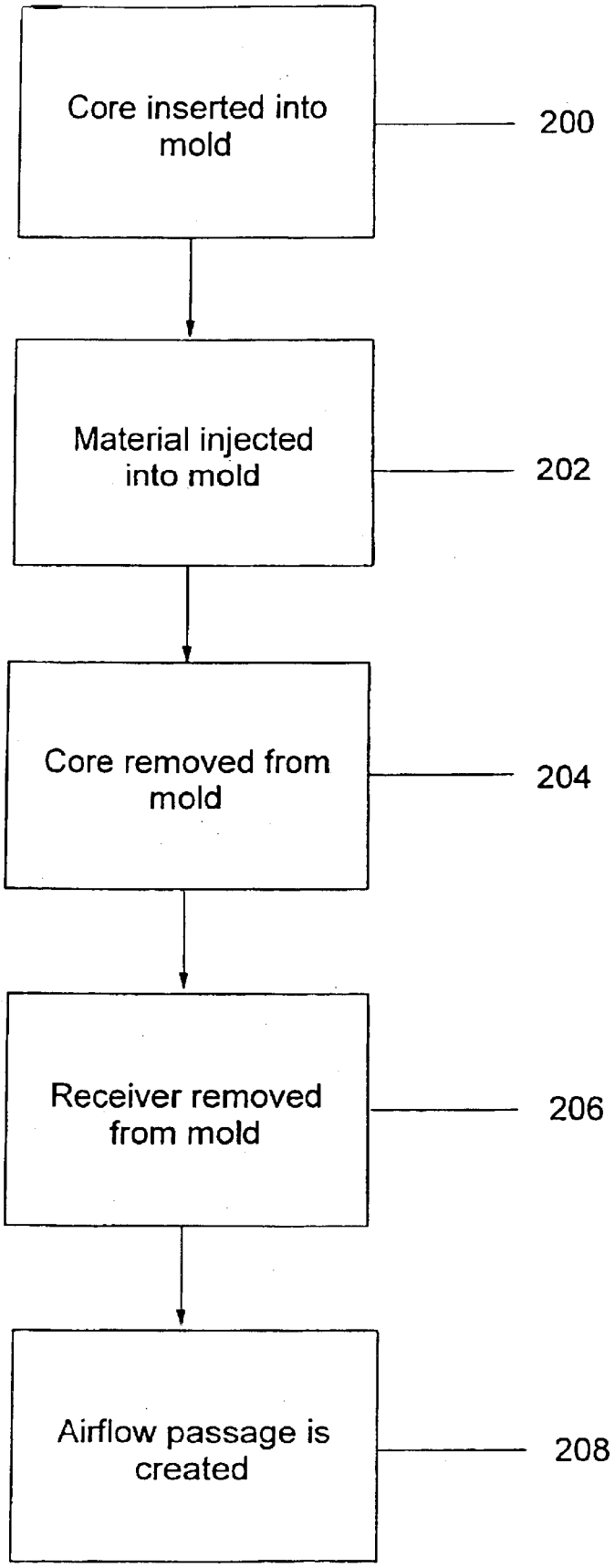
FIG. 12 is a flow chart illustrating the process for making a receiver for the embodiment shown in FIG. 1.
Figure 13:
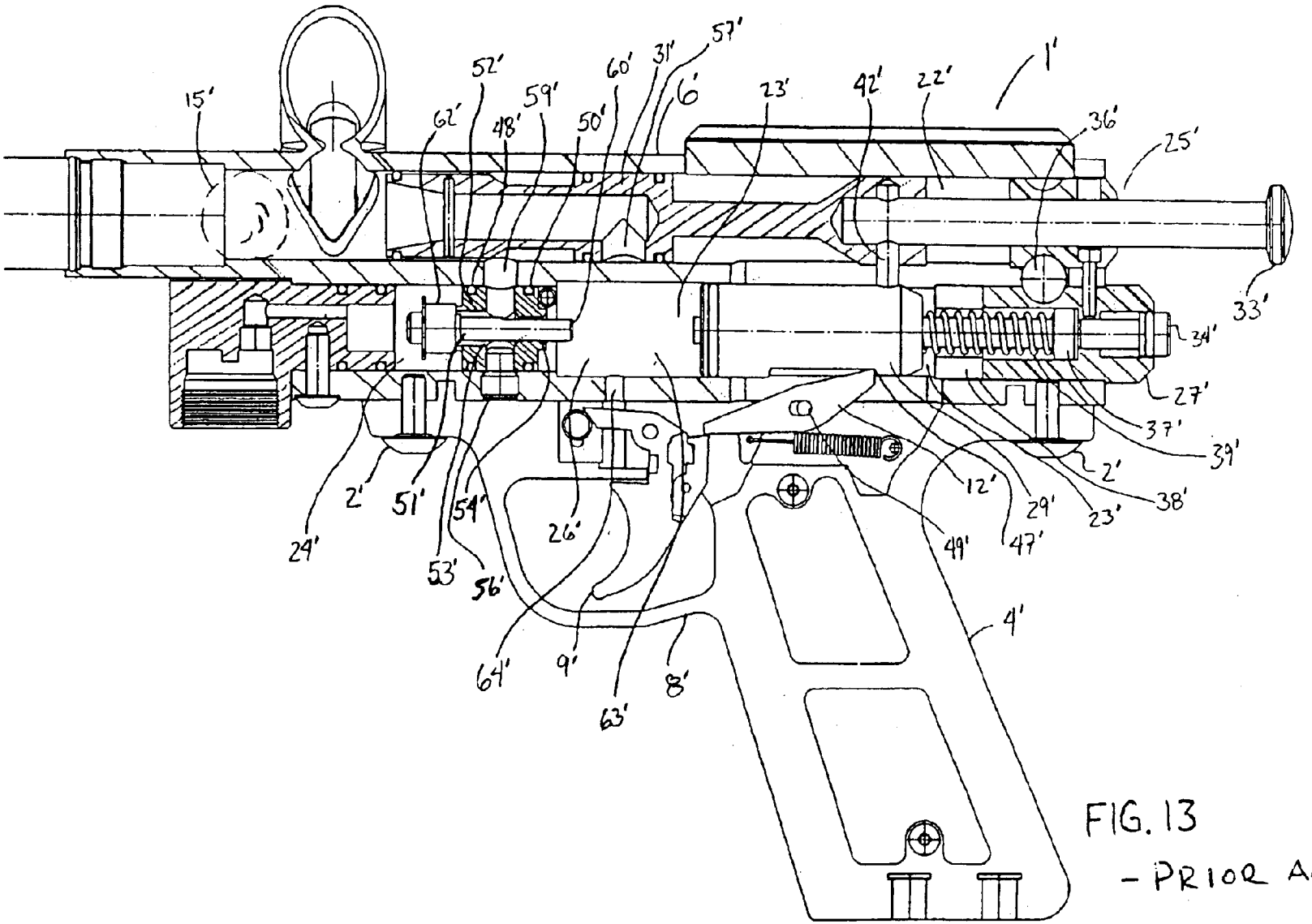
FIG. 13 is a plan view of a prior art paintball gun.

Receiver 6 is made according to the process next described and illustrated in FIGS. 10 and 11, and the flowchart in FIG. 12. At step 200, core 150 is inserted into a mold 155. Mold 155 forms the outer contours of receiver 6, and core 150 forms the interior contours of receiver 6. Core 150 comprises first cylinder 151, second cylinder 152, and web 154 attaching first cylinder 151 in parallel to second cylinder 152, thereby forming two linearly-adjacent cylinders. At step 202, a plastic material, such as a polymer, is injected into mold 155. At step 204, core 150 is removed from mold 155, and at step 206 receiver 6 is removed from mold 155.

The valve 55 of receiver 6 is made according to the process next described and illustrated in FIGS. 10 and 11. In step 200, core 150 is inserted into mold 155. As on shown in FIG. 11, core 150 comprises first cylinder 151 having first diameter 170, second diameter 172, and third diameter 174, wherein second diameter 172 is smaller than first 170 and third diameters 174. Moreover, fourth diameter 176 may be further provided. Each of the diameters 170, 172, 174, 176, correspond with second chamber 26, port 53, first chamber 24, and port 54, respectively. The diameter 172 and 176 may be adapted to allow for optimum airflow between port 59 and 54 to achieve the most efficient air bursts to fire the projectile and blow back hammer 29, as described above. Core 150 further comprises second cylinder 152 positioned in parallel with first cylinder 151.

While core 150 may be referred to as a single body, those of skill in the art will understand that core 150 may be comprised of several sections, or cores, to accommodate the process. Indeed, as shown in FIG. 10, dividing core 150 into at least two pieces 171, 173 facilitates removal of core 150 from the mold 155, as shown and discussed. For clarity, FIGS. 10 and 11 illustrate the portion of core 150 in partial cut-away to show how the parts join together. When joined, core pieces 171, 173 provide a continuous void to form diameters 172, 176. In step 202, a plastic material is injected into mold 155. Upon the plastic material hardening, in step 204, core 150 is removed from mold 155 by retracting pieces 171, 173 from the hardened plastic in mold 155. At step 206, receiver 6 is removed from mold 155.

In step 208, bore 185, shown in FIG. 1, is created between second diameter 172 of first cylinder 151 and second cylinder 152. Bore 185 can be formed by various machining processes, such as drilling. Bolt 190, shown in FIG. 2, is fitted into bore 185 leaving port 59. Meanwhile, second diameter 172 forms valve 53, and fourth diameter 176 forms valve 54.

As illustrated in FIG. 1, barrel 65 is attached to receiver 6 by cowl 104. Receiver 6 is comprised of a polymer defining first bore 22. Cowl 104 is also made of a polymer, and retainer 105 is comprised of a hardened material molded into cowl 104. Cowl 104 is attached to receiver 6 by pins 106, 107. Barrel 65 is removeably attached to receiver 6 by attaching to retainer 105 on cowl 104. In one embodiment, the retainer is comprised of metal, although other hardened materials can be used, such as, for example, ceramic. Barrel 65 can be attached to receiver 6 by various mechanisms. For example, a projection may be attached to one of either retainer 6 or barrel 65 and a receptacle attached to the other of either barrel 65 or retainer 6, so that the projection and the receptacle cooperate to selectively engage each other. This may be accomplished, for example, by retainer 105 and barrel 65 being cooperatively threaded, or by using a mating bayonet connector. As shown in FIG. 2, cowl 104 further provides port 108 to communicate compressed air from linkage 21 to integral valve 55. Seal 109 prevents compressed air from leaking between cowl 104 and receiver 6, thereby sealing first chamber 24. Finally, cowl 104 also houses spring 61, which maintains pressure on poppet 51.

FIG. 2 illustrates bottom air source adapter 20 for use in paintball gun 1. Adapter 20 comprises body 110 comprising a rigid substrate, which body 110 defines an airway passage 112. Body 110 has a first end 114 having a first fitting 115 and second end 116 having a second fitting 117. In one embodiment, first fitting 115 is an ⅛ inch national gas organization (ngo) pipe thread female fitting and second fitting 117 is an 825-14 ngo female fitting. The ⅛ inch ngo fitting is connected to flexible tubing 21, which communicates with first chamber 24. The 825 14 ngo fitting is made to connect to a standard paintball air tank (not shown). Casing 120 comprises a polymer, such as plastic, and is over-molded on body 110, and casing 120 has projection 121 for attaching to grip 4.

Grip 4 further comprises a frame 125 defining substantially recessed interior portion forming receptacle 127. Projection 121 is integrally attached to adapter 20, and projection 121 fits into receptacle 127. At least one member 129 attaches projection 121 to frame 125. As shown in FIGS. 1 and 2, the member 129 is a threaded fastener for bolting frame 125 to projection 121. Members 129, 129 attach adapter 20 to grip 4 using tension force, which is particularly desirable given the weight that the compressed air tank exerts on adapter 20 during use. When the compression air tank is connected to adapter 20, the weight of the tank is cantilevered back from grip 4, putting significant rotational force on the connection between grip 4 and adapter 20. The tensile force provided by members 129, 129 safely accommodate these forces. In another embodiment, member 129 may form a protrusion on one of either receptacle 128 or projection 121 and a cooperating receiver may be provided on the other of either projection 121 or receptacle 128. In this embodiment, projection 121 and receiver snap together, thereby coupling to attach projection 121 to frame 125.

While the invention has been particularly shown and described with reference to a particular embodiment thereof, it will be understood by those skilled in the art that various changes in form and detail may be made therein without departing from the spirit and scope of the invention. The present example and embodiment, therefore, are to be considered in all respects as illustrative and not restrictive, and the invention is not to be limited to the details given herein.

What is claimed is:

1. An apparatus for firing a paintball projectile, the apparatus comprising:

a grip;

a receiver hingedly attached to the grip, enabling the grip and the receiver to move from an adjacent position to an open position;

a projection on one of either the grip or the receiver; and a retainer fixedly attached to the other of either the grip or the receiver, the projection and the retainer cooperating to selectively engage each other, thereby retaining the grip and the receiver in a fixed relationship;

wherein the projection is adapted to receive the retainer, the retainer being capable of moving from a first position to a second position, the retainer engaging with the projection in the first position and the retainer disengaging with the projection in the second position;

wherein the projection includes an engaging surface adapted to mate with the retainer, the engaging surface being a substantially semi-circular channel positioned transversely along the projection; and whereby the retainer is a semi-circular shaft and is positioned to mate with the engaging surface in the first position and to disengage the engaging surface when rotated 180° into the second position.

2. The apparatus of claim 1, wherein the apparatus further comprises:

a hammer housed within the receiver, the hammer being capable of moving from a ready position to a firing position when the grip and the receiver are in the adjacent position;

a safety retainer associated with the receiver, and a safety projection associated with the grip, the safety retainer and safety projection engaging one another when the hammer is in the ready position;

whereby engaging the safety retainer and safety projection maintains the grip and the receiver in the fixed relationship, regardless of whether the projection and the retainer are engaged.

3. The apparatus of claim 2, wherein the apparatus further comprises;

a sear mounted on the grip;

wherein the safety projection is attached to the sear, the sear being moveable from a third position, in which the safety projection disengages the safety retainer, to a fourth position, in which the safety projection engages the safety retainer; and wherein the hammer is urged from the ready position to the firing position such that when the hammer is the ready position, the sear engages the hammer and the hammer urges the sear from the third position to the fourth position to thereby engage the safety projection and the safety retainer.

4. The apparatus of claim 3, wherein when the grip and the receiver are in the open position, the hammer may be inserted into the receiver without contacting the sear.

5. The apparatus of claim 1, wherein the apparatus further comprises:

a hammer housed within the receiver, the hammer being capable of moving from a ready position to a firing position when the grip and the receiver are in the adjacent position; and a safety member in a fifth position for engaging the retainer when the hammer is in the ready position and thereby preventing the retainer from disengaging the projection.

6. The apparatus of claim 5, wherein when the hammer is not in the ready position and when the retainer is not in the first position, the retainer urges the safety member into a sixth position whereby the safety member blocks the hammer from moving into the ready position.

7. The apparatus of claim 6, wherein the safety member has a first end in contact with the retainer and a second end, the second end having a hammer-engaging surface and a hammer-blocking surface, and wherein, when the retainer is moved from the first position, the retainer urges the safety member Into the sixth position.

8. The apparatus of claim 7, wherein, when the hammer is in the ready position, the hammer is adjacent the hammer-engaging surface, thereby preventing the safety member from moving into the sixth position and preventing the retainer from moving into the second position.

9. The apparatus of claim 7, wherein, when the hammer is not in the ready position, and the retainer is not in the first position, the retainer urges the safety member into the sixth position and the hammer-blocking surface prevents the hammer from moving into the ready position.

* * * * *